US010614763B2

(12) United States Patent
Jeong et al.

(10) Patent No.: US 10,614,763 B2
(45) Date of Patent: Apr. 7, 2020

(54) COMMUNICATION METHOD AND DISPLAY DEVICE USING THE SAME

(71) Applicant: LG DISPLAY CO., LTD., Seoul (KR)

(72) Inventors: Uitaek Jeong, Goyang-si (KR); GeunWoo Lee, Seoul (KR); Jaeyeon Song, Paju-si (KR); Ansu Kim, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 55 days.

(21) Appl. No.: 15/835,139

(22) Filed: Dec. 7, 2017

(65) Prior Publication Data

US 2019/0043427 A1 Feb. 7, 2019

(30) Foreign Application Priority Data

Aug. 4, 2017 (KR) ..... 10-2017-0099230

(51) Int. Cl.

| | |
|---|---|
| ***G09G 3/3258*** | (2016.01) |
| ***G09G 3/3266*** | (2016.01) |
| ***G09G 3/3275*** | (2016.01) |
| ***G09G 5/00*** | (2006.01) |
| ***G09G 3/20*** | (2006.01) |
| ***G09G 3/3233*** | (2016.01) |

(52) U.S. Cl.

CPC ..... *G09G 3/3258* (2013.01); *G09G 3/2096* (2013.01); *G09G 3/3233* (2013.01); *G09G 3/3266* (2013.01); *G09G 3/3275* (2013.01); *G09G 5/006* (2013.01); *G09G 2310/0243* (2013.01); *G09G 2370/04* (2013.01); *G09G 2370/08* (2013.01); *G09G 2370/10* (2013.01); *G09G 2370/14* (2013.01)

(58) Field of Classification Search

CPC .. G09G 3/3258; G09G 3/3275; G09G 3/3266; G09G 2310/0243

See application file for complete search history.

(56) References Cited

U.S. PATENT DOCUMENTS

| | | | | |
|---|---|---|---|---|
| 8,289,258 | B2 * | 10/2012 | Song | G09G 3/3611 345/213 |
| 9,270,869 | B1 * | 2/2016 | Watanabe | G09G 5/18 |
| 9,767,747 | B2 * | 9/2017 | Oh | G09G 3/3618 |
| 2002/0008682 | A1 * | 1/2002 | Park | G09G 3/20 345/87 |
| 2006/0284875 | A1 * | 12/2006 | Jeon | G06F 3/14 345/520 |

(Continued)

*Primary Examiner* — Nitin Patel
*Assistant Examiner* — Amy Onyekaba
(74) *Attorney, Agent, or Firm* — Seed Intellectual Property Law Group LLP

(57) ABSTRACT

Disclosed are a communication method, which is capable of being applied to a display device where a timing controller is provided in a system board instead of a display module, and a display device using the same. The communication method includes converting the digital video data and control signals into a transmission packet and transmitting the transmission packet from a first transmission module of a system board to a first receiving module of an interface board through a cable, restoring the digital video data and the control signals from the transmission packet, and transmitting the restored digital video data and control signals from the first receiving module to a display panel driver applying a plurality of driving signals to a display panel.

32 Claims, 15 Drawing Sheets

(56) References Cited

U.S. PATENT DOCUMENTS

| | | | | |
|---|---|---|---|---|
| 2008/0018793 | A1* | 1/2008 | Lee | H04N 5/45 348/581 |
| 2009/0146935 | A1* | 6/2009 | Song | G09G 3/3611 345/87 |
| 2009/0284455 | A1* | 11/2009 | Jung | G09G 3/3611 345/87 |
| 2010/0164940 | A1* | 7/2010 | Jang | G09G 3/3614 345/214 |
| 2010/0164985 | A1* | 7/2010 | Kim | G09G 3/3614 345/618 |
| 2011/0037760 | A1* | 2/2011 | Kim | G09G 3/3614 345/214 |
| 2011/0157104 | A1* | 6/2011 | Kang | G09G 3/2096 345/204 |
| 2014/0176622 | A1* | 6/2014 | Jung | G09G 3/3208 345/690 |
| 2014/0177182 | A1* | 6/2014 | Cho | H05K 3/30 361/749 |
| 2015/0138179 | A1* | 5/2015 | Park | G09G 3/3233 345/212 |
| 2015/0379937 | A1* | 12/2015 | Kim | G09G 3/006 345/691 |
| 2016/0163265 | A1* | 6/2016 | Yang | G09G 3/3233 345/690 |
| 2016/0189621 | A1* | 6/2016 | Kim | G09G 3/3258 345/215 |
| 2017/0287415 | A1* | 10/2017 | Wu | G06F 13/1694 |

* cited by examiner

FIG. 10A

1 Lane = { R1[9:2], W1[9:2], G1[9:2], B1[9:2] }
2 Lane = { R2[9:2], W2[9:2], G2[9:2], B2[9:2] }
3 Lane = { R3[9:2], W3[9:2], G3[9:2], B3[9:2] }
4 Lane = { R4[9:2], W4[9:2], G4[9:2], B4[9:2] }
5 Lane = { R1[1:0], W1[1:0], G1[1:0], B1[1:0], R2[1:0], W2[1:0], G2[1:0], B2[1:0], · · · , R4[1:0], W4[1:0], G4[1:0], B4[1:0] }

⋮

11 Lane = { R9[9:2], W9[9:2], G9[9:2], B9[9:2] }
12 Lane = { R10[9:2], W10[9:2], G10[9:2], B10[9:2] }
13 Lane = { R11[9:2], W11[9:2], G11[9:2], B11[9:2] }
14 Lane = { R12[9:2], W12[9:2], G12[9:2], B12[9:2] }
15 Lane = { R9[1:0], W9[1:0], G9[1:0], B9[1:0], R10[1:0], W10[1:0], G10[1:0], B10[1:0], · · · , R12[1:0], W12[1:0], G12[1:0], B12[1:0] }

FIG. 10B

1 Lane = { R1[9:0], W1[9:0], G1[9:0], B1[9:0] }
2 Lane = { R2[9:0], W2[9:0], G2[9:0], B2[9:0] }
3 Lane = { R3[9:0], W3[9:0], G3[9:0], B3[9:0] }
4 Lane = { R4[9:0], W4[9:0], G4[9:0], B4[9:0] }
5 Lane = { R5[9:0], W5[9:0], G5[9:0], B5[9:0] }

⋮

11 Lane = { R11[9:0], W11[9:0], G11[9:0], B11[9:0] }
12 Lane = { R12[9:0], W12[9:0], G12[9:0], B12[9:0] }

FIG. 11A

1 Lane = { R1[9:2], W1[9:2], G1[9:2], B1[9:2] }
2 Lane = { R2[9:2], W2[9:2], G2[9:2], B2[9:2] }
3 Lane = { R3[9:2], W3[9:2], G3[9:2], B3[9:2] }
4 Lane = { R4[9:2], W4[9:2], G4[9:2], B4[9:2] }
5 Lane = { R1[1:0], W1[1:0], G1[1:0], B1[1:0], R2[1:0], W2[1:0],
G2[1:0], B2[1:0], · · · , R4[1:0], W4[1:0], G4[1:0], B4[1:0] }

⋮

21 Lane = { R17[9:2], W17[9:2], G17[9:2], B17[9:2] }
22 Lane = { R18[9:2], W18[9:2], G18[9:2], B18[9:2] }
23 Lane = { R19[9:2], W19[9:2], G19[9:2], B19[9:2] }
24 Lane = { R20[9:2], W20[9:2], G20[9:2], B20[9:2] }
25 Lane = { R17[1:0], W17[1:0], G17[1:0], B17[1:0],
· · · , R20[1:0], W20[1:0], G20[1:0], B20[1:0] }

FIG. 11B

1 Lane = { R1[9:0], W1[9:0], G1[9:0], B1[9:0] }
2 Lane = { R2[9:0], W2[9:0], G2[9:0], B2[9:0] }
3 Lane = { R3[9:0], W3[9:0], G3[9:0], B3[9:0] }
4 Lane = { R4[9:0], W4[9:0], G4[9:0], B4[9:0] }

⋮

17 Lane = { R17[9:0], W17[9:0], G17[9:0], B17[9:0] }
18 Lane = { R18[9:0], W18[9:0], G18[9:0], B18[9:0] }
19 Lane = { R19[9:0], W19[9:0], G19[9:0], B19[9:0] }
20 Lane = { R20[9:0], W20[9:0], G20[9:0], B20[9:0] }

COMMUNICATION METHOD AND DISPLAY DEVICE USING THE SAME

CROSS-REFERENCE TO RELATED APPLICATIONS

This application claims the benefit of the Korean Patent Application No. 10-2017-0099230 filed on Aug. 4, 2017, which is hereby incorporated by reference as if fully set forth herein.

BACKGROUND

Technical Field

The present disclosure relates to a communication method and a display device using the same.

Description of the Related Art

With the advancement of information-oriented society, various requirements for display devices for displaying an image are increasing. Therefore, various flat panel display devices such as liquid crystal display (LCD) devices, plasma display panel (PDP) devices, organic light emitting display devices, etc. are being used recently. In such display devices, the organic light emitting display devices are driven with a low voltage and have a thin thickness, a good viewing angle, and a fast response time.

The organic light emitting display devices include a display panel which includes a plurality of data lines, a plurality of scan lines, and a plurality of pixels respectively provided in a plurality of pixel areas defined by intersections of the data lines and the scan lines, a scan driver which supplies scan signals to the scan lines, a data driver which supplies data voltages to the data lines, a timing controller which controls an operation timing of each of the scan driver and the data driver, and a power supply which supplies driving voltages to the pixels, the scan driver, the data driver, and the timing controller. Each of the pixels includes an organic light emitting diode (OLED), a driving transistor which controls the amount of current supplied to the OLED with a voltage of a gate electrode thereof, a scan transistor which supplies a data voltage of a data line connected thereto to the gate electrode of the driving transistor in response to a scan signal of a scan line connected thereto, and a storage capacitor which holds the voltage at the gate electrode of the driving transistor during a certain period.

A threshold voltage of the driving transistor for each pixel can be shifted due to a cause such as deterioration of the driving transistor caused by long-time driving or a process differential which occurs in manufacturing the organic light emitting display device. That is, in a case of applying the same data voltage to pixels, a current supplied to each of OLEDs should be constant, but due to a difference between threshold voltages of driving transistors of the pixels, even when the same data voltage is applied to the pixels, currents supplied to the OLEDs of the pixels can differ. Also, the OLEDs can be deteriorated due to long-time driving, and in this case, luminance of the OLEDs of the pixels can differ. For this reason, even when the same data voltage is applied to the pixels, luminance of lights emitted from the OLEDs of the pixels can differ. In order to solve such problems, a compensation method of compensating for a threshold voltage and an electron mobility of a driving transistor has been proposed.

The threshold voltage and electron mobility of the driving transistor may be compensated for by an external compensation method. The external compensation method is a method which supplies a predetermined data voltage to a pixel, senses a source voltage of the driving transistor through a sensing line, converts the sensed voltage into digital sensing data by using an analog-to-digital converter, and compensates for digital video data which is to be supplied to the pixel, based on the sensing data.

Recently, a split type organic light emitting display device where some elements of an organic light emitting display device are separated from the organic light emitting display device and are equipped in an external system board has been proposed. For example, a timing controller and a power supply may be separated from the organic light emitting display device and may be equipped in the external system board, and in this case, since the split type organic light emitting display device does not include a power plug as well as some elements removed therefrom, the split type organic light emitting display device is manufactured thinner and lighter than a related art organic light emitting display device.

In a case where the timing controller is equipped in the external system board, in order to protect content exposed to the outside, digital video data should be encrypted by high-bandwidth digital content protection (HDCP) technology and transmitted to a data driver. Examples of a general interface supported by the HDCP technology include a DVI, an HDMI, a DP, etc.

However, in a case where the organic light emitting display device compensates for the threshold voltage and electron mobility of the driving transistor by using the external compensation method, the data driver should transmit sensing data to the timing controller of the system board. However, since a currently commercialized interface (for example, the HDMI) transmits digital video data during an active period and transmits a unique packet during a vertical blank period, it is impossible for the data driver to transmit the sensing data to the timing controller of the system board. Therefore, it is required to develop a new interface capable of being applied to the split type organic light emitting display device using the external compensation method.

BRIEF SUMMARY

Accordingly, the present disclosure is directed to provide a communication method and a display device using the same that substantially obviate one or more problems due to limitations and disadvantages of the related art.

An aspect of the present disclosure is directed to provide a communication method, which is capable of being applied to a display device where a timing controller is provided in a system board instead of a display module, and a display device using the same.

Additional advantages and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

To achieve these and other advantages and in accordance with the purpose of the disclosure, as embodied and broadly described herein, there is provided a communication method including converting the digital video data and control signals into a transmission packet, transmitting the transmission packet from a first transmission module of a system board to a first receiving module of an interface board through a cable, restoring the digital video data and the control signals from the transmission packet, and transmitting the restored digital video data and control signals from the first receiving module to a display panel driver that applies a plurality of driving signals to a display panel.

In another aspect of the present disclosure, there is provided a display device including a display panel, a display panel driver that applies a plurality of driving signals to the display panel, and an interface board including a first receiving module, a system board including a timing controller that outputs digital video data and control signals for controlling an operation timing of the display panel driver, and a first transmission module that communicates with the first receiving module, and a cable that connects the interface board to the system board, wherein the first transmission module converts the digital video data and the control signals from the timing controller into a transmission packet, and transmits the transmission packet to the first receiving module through the cable.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain the principle of the disclosure. In the drawings:

FIGS. 10A and 10B are exemplary diagrams showing data transmitted by lanes of a cable in a case of transmitting digital video data through a V-by-one (V×1) interface in a full high definition (FHD) 4 byte mode and in a FHD 5 byte mode;

FIGS. 11A and 11B are exemplary diagrams showing data transmitted by lanes of a cable in a case of transmitting digital video data through a V×1 interface in an ultra-high definition (UHD) 4 byte mode and a UHD 5 byte mode;

DETAILED DESCRIPTION

Figure 1:
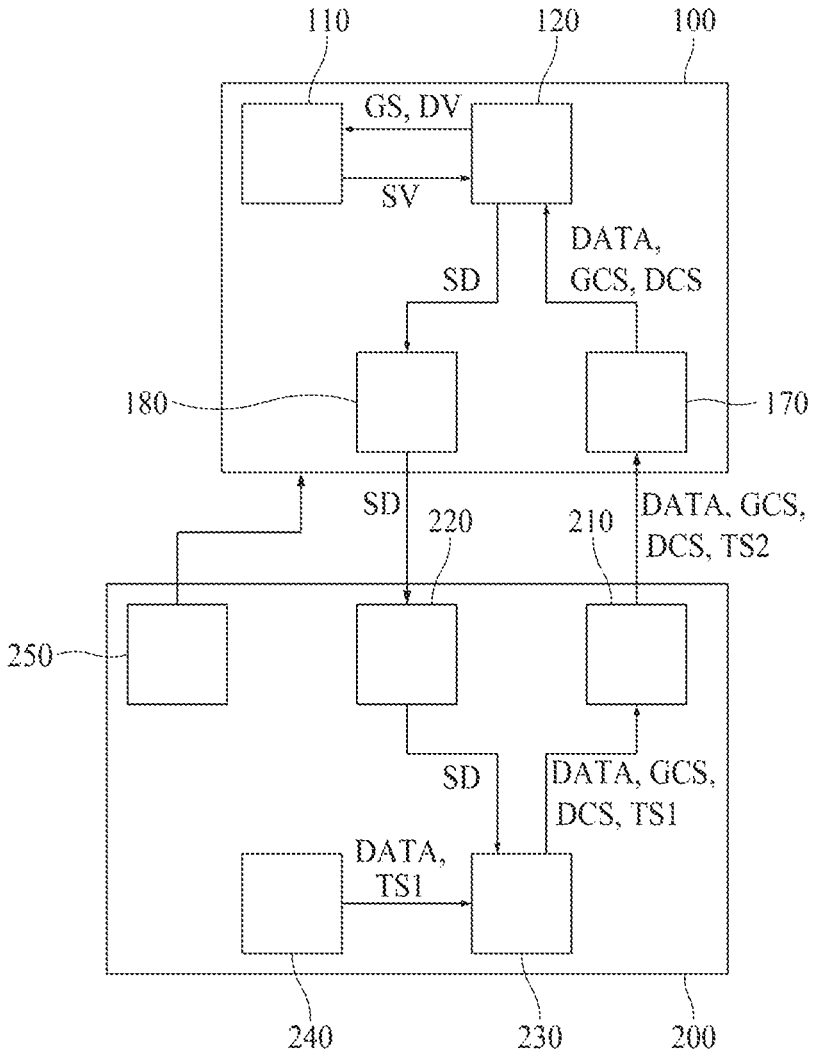
FIG. 1 is a block diagram schematically illustrating a display device according to an embodiment of the present disclosure.

Reference will now be made in detail to the exemplary embodiments of the present disclosure, examples of which are illustrated in the accompanying drawings. Wherever possible, the same reference numbers will be used throughout the drawings to refer to the same or like parts.

In the specification, it should be noted that like reference numerals already used to denote like elements in other drawings are used for elements wherever possible. In the following description, when a function and a configuration known to those skilled in the art are irrelevant to the essential configuration of the present disclosure, their detailed descriptions will be omitted. The terms described in the specification should be understood as follows.

Advantages and features of the present disclosure, and implementation methods thereof will be clarified through following embodiments described with reference to the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art. Further, the present disclosure is only defined by scopes of claims.

A shape, a size, a ratio, an angle, and a number disclosed in the drawings for describing embodiments of the present disclosure are merely an example, and thus, the present disclosure is not limited to the illustrated details. Like reference numerals refer to like elements throughout. In the following description, when the detailed description of the relevant known function or configuration is determined to unnecessarily obscure the important point of the present disclosure, the detailed description will be omitted.

In a case where 'comprise', 'have', and 'include' described in the present specification are used, another part may be added unless 'only' is used. The terms of a singular form may include plural forms unless referred to the contrary.

In construing an element, the element is construed as including an error range although there is no explicit description.

In describing a position relationship, for example, when a position relation between two parts is described as 'on~', 'over~', 'under~', and 'next~', one or more other parts may be disposed between the two parts unless 'just' or 'direct' is used.

In describing a time relationship, for example, when the temporal order is described as 'after~', 'subsequent~', 'next~', and 'before~', a case which is not continuous may be included unless 'just' or 'direct' is used.

It will be understood that, although the terms "first", "second", etc. may be used herein to describe various elements, these elements should not be limited by these terms. These terms are only used to distinguish one element from another. For example, a first element could be termed a second element, and, similarly, a second element could be termed a first element, without departing from the scope of the present disclosure.

An X axis direction, a Y axis direction, and a Z axis direction should not be construed as only a geometric relationship where a relationship therebetween is vertical, and may denote having a broader directionality within a scope where elements of the present disclosure operate functionally.

The term "at least one" should be understood as including any and all combinations of one or more of the associated listed items. For example, the meaning of "at least one of a first item, a second item, and a third item" denotes the combination of all items proposed from two or more of the first item, the second item, and the third item as well as the first item, the second item, or the third item.

Features of various embodiments of the present disclosure may be partially or overall coupled to or combined with each other, and may be variously inter-operated with each other and driven technically as those skilled in the art can sufficiently understand. The embodiments of the present disclosure may be carried out independently from each other, or may be carried out together in co-dependent relationship.

Hereinafter, exemplary embodiments of the present disclosure will be described in detail with reference to the accompanying drawings.

FIG. 1 is a block diagram schematically illustrating a display device according to an embodiment of the present disclosure.

Referring to FIG. 1, the display device according to an embodiment of the present disclosure may include a display module 100 and a system board 200. The display module 100 may be connected to the system board 200 through a cable 300 as in FIG. 2.

In an embodiment of the present disclosure, an example where the display module 100 is an organic light emitting display device will be described. The display module 100 may include a display panel 110, a display panel driver 120, a first receiving module 170, and a second transmission module 180.

The display panel 100 may include a plurality of data lines, a plurality of scan lines, and a plurality of pixels respectively provided in a plurality of pixel areas defined by intersections of the data lines and the scan lines. When a scan signal GS is applied through a corresponding scan line, each of the pixels may be supplied with a data voltage DV through a data line connected thereto and may emit light having certain brightness with the data voltage DV. Therefore, the display panel 100 may display an image by using the pixels.

The display panel driver 120 may receive digital video data DATA, a scan control signal GCS, and a data control signal DCS from the first receiving module 170. The display panel driver 120 may generate driving signals for driving the display panel 100 according to the scan control signal GCS and the data control signal DCS and may supply the driving signals to the display panel 100.

The display panel driver 120 may supply scan signals GS to the scan lines of the display panel 100 and may supply data voltages DV to the data lines.

Moreover, the display panel driver 120 may sense, through reference voltage lines, source voltages (i.e., sensing voltages SV) of driving transistors respectively provided in the pixels of the display panel 100. The display panel driver 120 may convert the sensing voltages SV into digital sensing data SD and may transmit the digital sensing data SD to the second transmission module 180. The display panel driver 120 may communicate with the second transmission module 180 through a bus-low voltage differential signal (B-LVDS) interface.

The first receiving module 170 may receive encrypted digital video data DATA, the control signals GCS and DCS, and second timing signals TS2 from the first transmission module 210 of the system board 200 through a cable 300. The first receiving module 170 may decrypt the encrypted digital video data DATA and may transmit the decrypted digital video data DATA and the control signals to the display panel driver 120. The first receiving module 170 may communicate with the display panel driver 120 through an embedded point to point interface (EPI).

The second transmission module 180 may transmit the sensing data SD to the second receiving module 220 of the system board 200 through the cable 300. The second transmission module 180 may communicate with the second receiving module 220 through an LVDS interface.

The system board 200 may include a first transmission module 210, a second receiving module 220, a timing controller 230, a system on chip (SoC) 240, and a power supply 250.

The SoC 240 may include a scaler and may convert input digital video data into data having a resolution suitable for display by the display module 100. The SoC 240 may output the digital video data DATA and first timing control signals TS1 to the timing controller 230. The first timing signals TS1 may include a horizontal sync signal Hsync, a first vertical sync signal Vsync1, a first data enable signal DE1, a dot clock CLK, etc. The SoC 240 may communicate with the timing controller 230 through the LVDS interface.

The timing controller 230 may receive the digital video data DATA and the first timing signals TS1 from the SoC 240 and may receive the sensing data SD from the second receiving module 220. The timing controller 230 may include a non-volatile memory (for example, electrically erasable programmable read-only memory (EEPROM)) and may store the sensing data SD in the memory. The timing controller 230 may compensate for the digital video data DATA by using the sensing data SD, thereby compensating for a threshold voltage and an electron mobility of a driving transistor of each of the pixels provided in the display panel 110.

The timing controller 230 may generate the control signals GCS and DCS for controlling an operation timing of the display panel driver 120 according to the first timing signals TS1. The timing controller 230 may transmit the digital video data DATA, the control signals GCS and DCS, and the first timing signals TS1 to the first transmission module 210. The timing controller 230 may communicate with the first transmission module 210 through a V×1 interface.

The first transmission module 210 may generate the second timing signals TS2 from the first timing signals TS1, encrypt the digital video data DATA, and transmit the encrypted digital video data DATA, the control signals GCS and DCS, and the second timing signals TS2 to the first receiving module 170 through the cable 300.

The first transmission module 210 may communicate with the first receiving module 170 through a high speed serial interface (for example, the V×1 interface). Since the V×1 interface is the high speed serial interface requiring no clock transmission of a fixed frequency, an EMI noise is more reduced in a case of using the V×1 interface than a case of using the LVDS interface requiring the clock transmission of the fixed frequency. Also, the V×1 interface may transmit data at a speed which is higher than the LVDS interface, thereby decreasing the number of lines of a cable in comparison with the LVDS interface. That is, in an embodiment of the present disclosure, a communication interface between the first receiving module 170 and the first transmission module 210 for transmitting a large amount of data may transmit data at a speed which is higher than a communication interface between the second transmission module 180 and the second receiving module 220, thereby minimizing the number of the lines of the cable.

The second receiving module 220 may receive the sensing data SD from the first transmission module 180 of the display module 100 through the cable 300. The second receiving module 220 may transmit the sensing data SD to the timing controller 230. The second receiving module 220 may communicate with the timing controller 230 through the B-LVDS interface.

The power supply 250 may generate a plurality of driving voltages for driving the first transmission module 210, the second receiving module 220, the timing controller 230, and the SoC 240 of the system board 200 and may supply the driving voltages to the first transmission module 210, the second receiving module 220, the timing controller 230, and the SoC 240. Also, the power supply 250 may generate the driving voltages for driving the display module 100 and may supply the driving voltages to the display module 100 through the cable 300.

Figure 2:
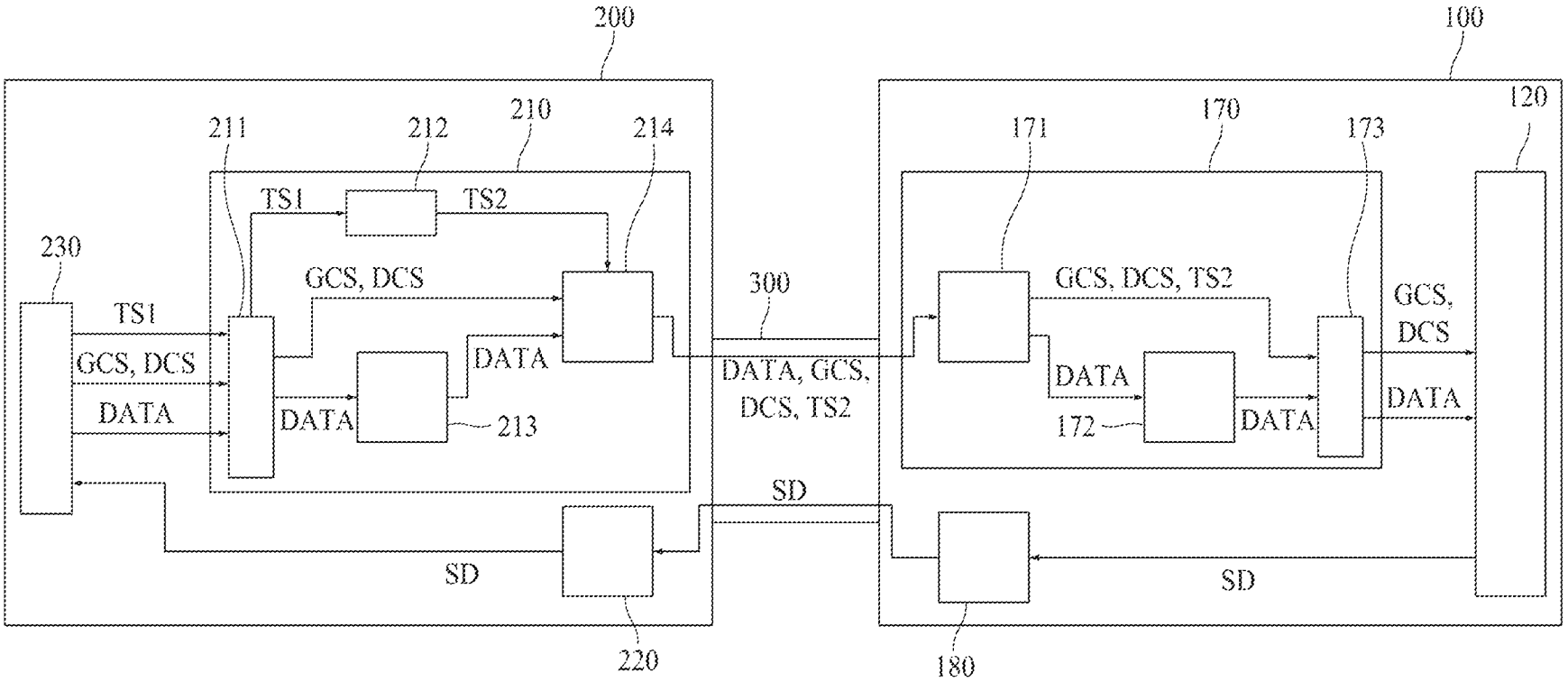
FIG. 2 is a block diagram schematically illustrating a power supply, a timing controller, a first transmission module, a second transmission module, a first receiving module, and a second receiving module illustrated in FIG. 1.
Figure 3:
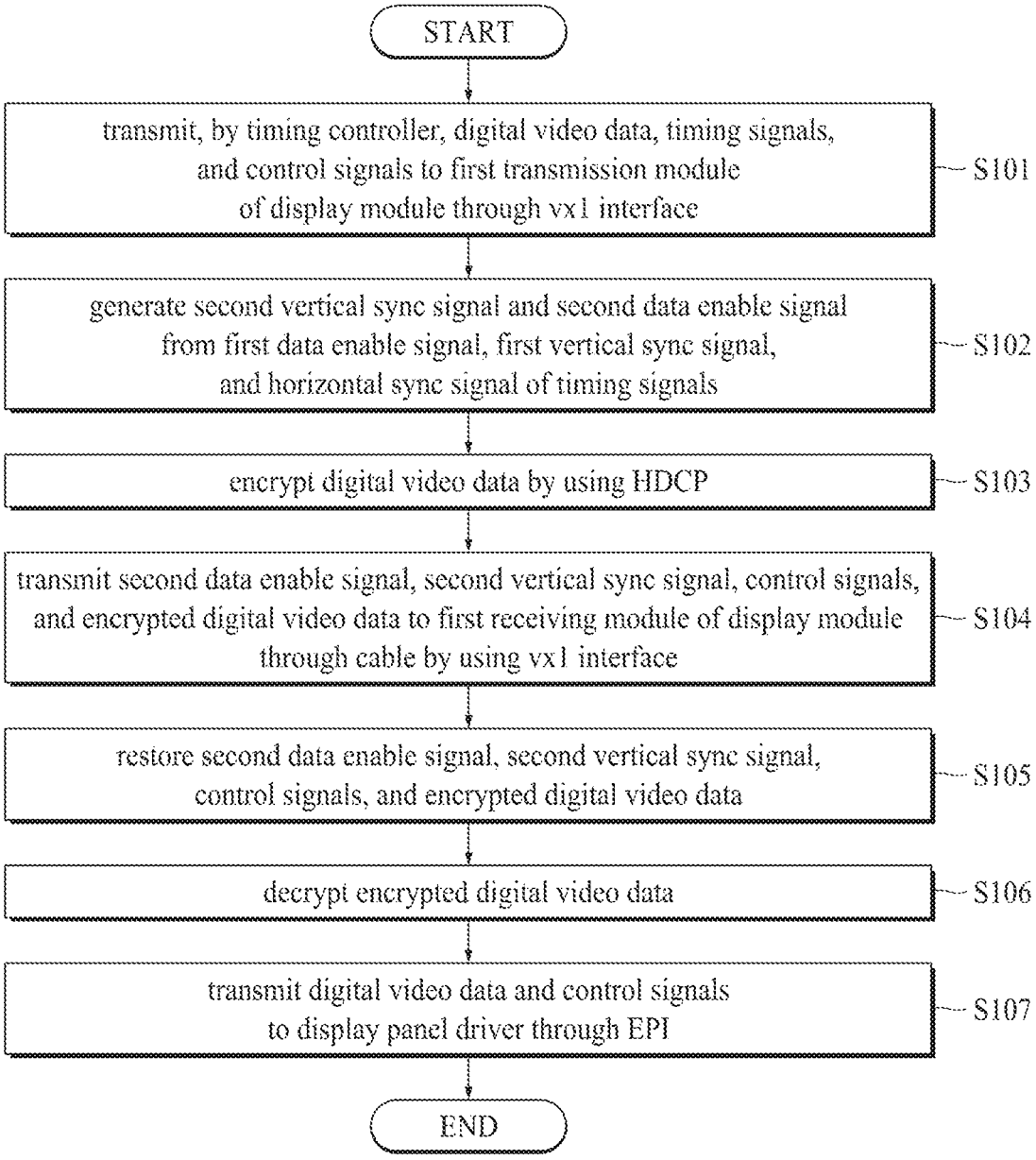
FIG. 3 is a flowchart illustrating a communication method performed on a display module by a system board.
Figure 4:
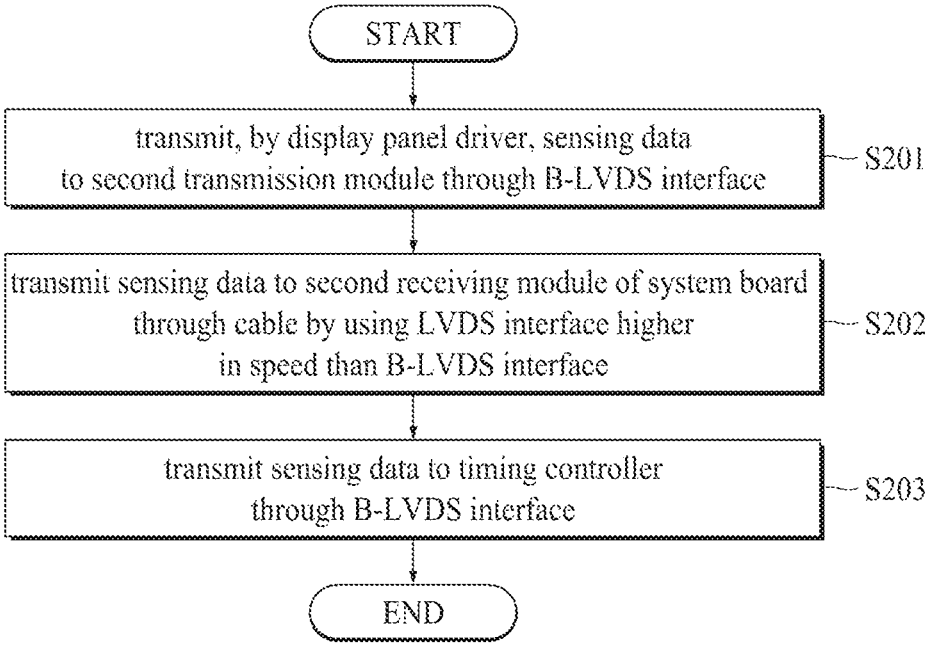
FIG. 4 is a flowchart illustrating a communication method performed on a system board by a display module.

FIG. 2 is a block diagram schematically illustrating the power supply, the timing controller, the first transmission module, the second transmission module, the first receiving module, and the second receiving module illustrated in FIG. 1. FIG. 3 is a flowchart illustrating a communication method performed on the display module by the system board. FIG. 4 is a flowchart illustrating a communication method performed on the system board by the display module.

First, a communication method performed on the display module 100 by the system board 200 will be described in detail with reference to FIGS. 2 and 3.

The first transmission module 210 may include an input buffer unit 211, a first sync signal generator 212, a data encryption unit 213, and a V×1 transmitter 214.

The input buffer unit 211 may receive the digital video data DATA, the control signals GCS and DCS, and the first timing signals TS1 from the timing controller 230. The timing controller 230 may communicate with the first transmission module 210 through the V×1 interface. In this case, the timing controller 230 may include a V×1 transmitter, and the input buffer unit 211 may include a V×1 receiver. The input buffer unit 211 may transmit the first timing signals TS1 to the first sync signal generator 212, transmit the digital video data DATA to the data encryption unit 213, and transmit the control signals GCS and DCS to the V×1 transmitter 214. (S101 of FIG. 3)

The first sync signal generator 212 may generate a second vertical sync signal Vsync2 and a second data enable signal DE2 from the first vertical sync signal Vsync1, the horizontal sync signal Hsync, and the first data enable signal DE1 which are included in the first timing signals TS1. The first sync signal generator 212 may transmit the second timing signals TS2 to the V×1 transmitter 214.

The first sync signal generator 212 may differently generate the second vertical sync signal Vsync2 and the second data enable signal DE2 in first to third driving modes of the display panel 110. The second vertical sync signal Vsync2 and the second data enable signal DE2 generated in each of the first to third driving modes will be described below with reference to FIGS. 5, 7, and 8. (S102 of FIG. 3)

The data encryption unit 213 may encrypt the digital video data DATA by using HDCP technology for preventing the copy of content, so as to protect content expose to the outside. The data encryption unit 213 may transmit the encrypted digital video data DATA to the V×1 transmitter 214. (S103 of FIG. 3)

The V×1 transmitter 214 may control a transmission timing of each of the encrypted digital video data DATA, the control signals GCS and DCS, and the second timing signals TS2 according to a timing of each of the second timing signals TS2 transmitted from the first sync signal generator 212. In detail, the V×1 transmitter 214 may convert the second timing signals TS2 and the control signals GCS and DCS, which are analog signals, into the form of digital data. Subsequently, the V×1 transmitter 214 may convert each of the encrypted digital video data DATA, the control signals GCS and DCS, and the second timing signals TS2 into a V×1 transmission packet according to the timing of each of the second timing signals TS2 and may transmit the V×1 transmission packet to the first receiving module 170 through the cable 300. (S104 of FIG. 3)

The first receiving module 170 may include a V×1 receiver 171, a data restorer 172, and a second sync signal generator 173.

The V×1 receiver 171 may restore the encrypted digital video data DATA, the control signals GCS and DCS, and the second timing signals TS2 from the V×1 transmission packet transmitted from the first transmission module 210 through the cable 300. The V×1 receiver 171 may transmit the encrypted digital video data DATA to the data restorer 172. The V×1 receiver 171 may convert the control signals GCS and DCS and the second timing signals TS2, having the form of digital data, into analog signals and may transmit the analog signals to the second sync signal generator 173. (S105 of FIG. 3)

The data restorer 172 may restore the encrypted digital video data DATA by using an HDCP restoration algorithm. The data restorer 172 may transmit the restored digital video data DATA to the second sync signal generator 173. (S106 of FIG. 3)

The second sync signal generator 173 may transmit the restored digital video data DATA and control signals GCS and DCS to the display panel driver 120 according to the timing of each of the second timing signals TS2. The second sync signal generator 173 may communicate with the display panel driver 120 through the EPI. In this case, the second sync signal generator 173 may include an EPI transmitter, and the display panel driver 120 may include an EPI receiver. (S107 of FIG. 3)

Second, a communication method performed on the system board 200 by the display module 100 will be described in detail with reference to FIGS. 2 and 4.

The second transmission module 180 may receive the sensing data SD from the display panel driver 120 through the B-LVDS interface. (S202 of FIG. 4)

The second transmission module 180 may communicate with the second receiving module 220 of the system board 200 through the cable 300 by using the LVDS interface where the number of clocks is reduced and a transmission speed increases in comparison with the B-LVDS interface, and thus, the number of lanes of the cable 300 is reduced. (S202 of FIG. 4)

The second receiving module 220 may convert the sensing data SD based on the LVDS interface into sensing data based on the B-LVDS interface and may transmit the sensing data to the timing controller 230. That is, the second receiving module 220 may communicate with the timing controller 230 through the B-LVDS interface. In this case, the timing controller 230 may include a B-LVDS receiver. The timing controller 230 may receive the sensing data SD by using the B-LVDS receiver. (S203 of FIG. 4)

Moreover, the power supply 250 of the system board 200 may supply a plurality of driving voltages to the first transmission module 210, the second receiving module 220, the timing controller 230, and the SoC 240 of the system board 200. Also, the power supply 250 may supply the plurality of driving voltages to the display module 100 through the cable 300. For example, the power supply 250 may supply an input power Vin supplied to a plurality of source drive integrated chips (ICs), a low level voltage ELVSS and a high level voltage EVDD for driving OLEDs of the pixels of the display panel 110, and a ground voltage GND to the display module 100 through the cable 300.

As described above, in an embodiment of the present disclosure, the timing controller 230 may be equipped in the system board 200 instead of the display module 100, and a transmission module and a receiving module may be provided in each of the display module 100 and the system board 200. As a result, in an embodiment of the present disclosure, bidirectional communication may be performed through the cable 300, and thus, in an organic light emitting display device using an external compensation method, although the timing controller 230 is provided in the system board 200, a new interface for transmitting the digital video data DATA of the timing controller 230 of the system board 200 to the display module 100 and transmitting the sensing data SD, sensed from the display panel 110, from the display module 100 to the timing controller 230 of the system board 200 is provided.

Moreover, in an embodiment of the present disclosure, the power supply 250 as well as the timing controller 230 may be provided in the system board 200 instead of the display module 100, and a plurality of driving voltages may be supplied to the display module 100 through the cable 300. As a result, in an embodiment of the present disclosure, in addition to the power supply 250, a power plug for receiving power may be removed from the display device, thereby providing a slimmed display device.

Figure 5:
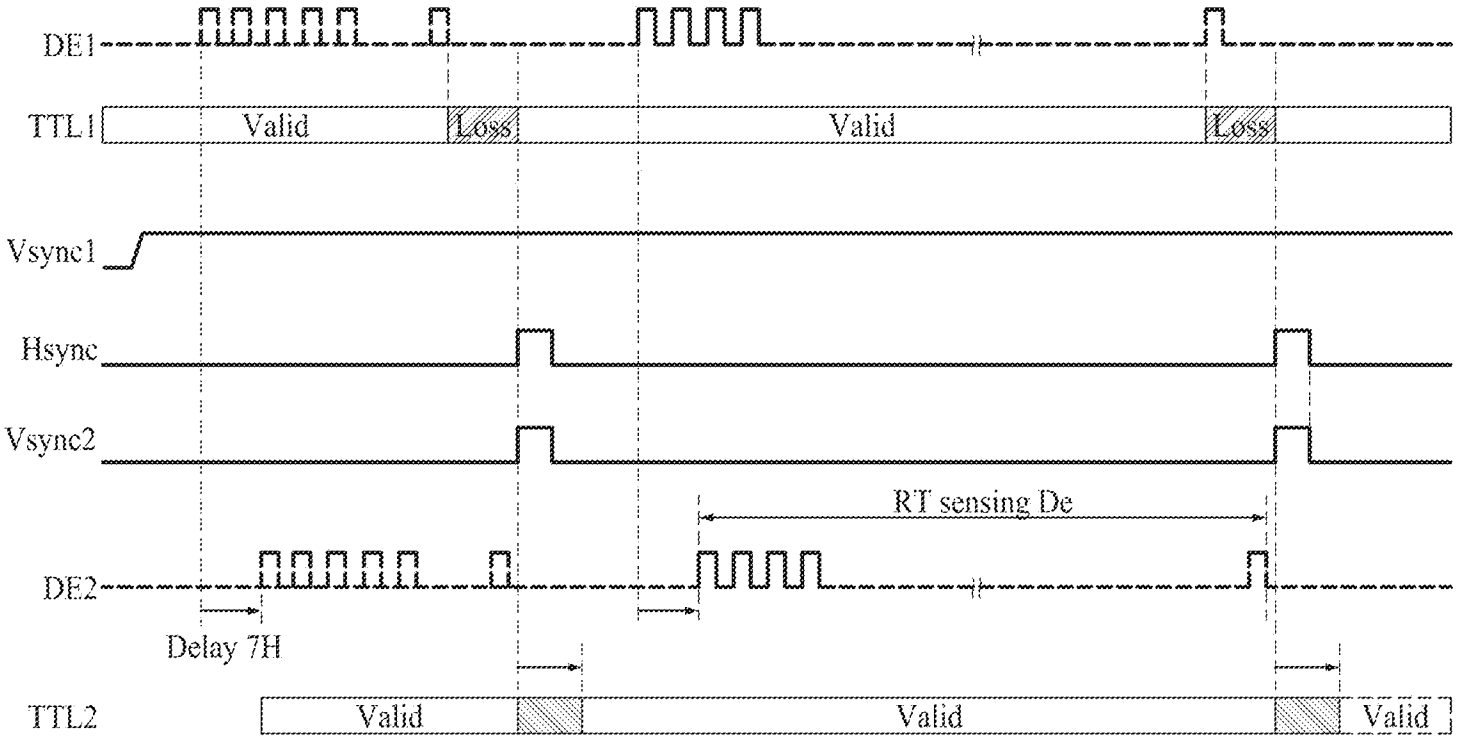
FIG. 5 is a waveform diagram showing a first data enable signal, a first vertical sync signal, and a horizontal sync signal output from a timing controller and a second data enable signal and a second vertical sync signal output from a first sync signal generator, in a first driving mode.

FIG. 5 is a waveform diagram showing a first data enable signal, a first vertical sync signal, and a horizontal sync signal output from a timing controller and a second data enable signal and a second vertical sync signal output from a first sync signal generator, in a first driving mode.

Hereinafter, a method of generating, by the first sync signal generator 212, the second vertical sync signal Vsync2 and the second data enable signal DE2 in the first driving mode will be described in detail with reference to FIG. 5.

Referring to FIG. 5, the first driving mode is an electron mobility compensation mode of sensing the source voltage of the driving transistor for compensating for the electron mobility of the driving transistor of each pixel of the display panel 110 as soon as the display device is turned on.

The timing controller 230 outputs the first vertical sync signal Vsync1, the horizontal sync signal Hsync, the first data enable signal DE1, and control signals TTL1 in the first driving mode. Also, the timing controller 230 outputs the digital video data DATA including only first sensing video data in the first driving mode. The first sensing video data denotes data which is to be supplied to each of the pixels so as to compensate for the electron mobility of the driving transistor.

In the first driving mode, the first vertical sync signal Vsync1 is generated as a first logic voltage. Data enable pulses of one group of the first data enable signal DE1 may be generated for 30 ms to 200 ms. In a case where the data enable pulses of the one group are generated for 30 ms, the one group may include about 8,500 data enable pulses.

In the first driving mode, the horizontal sync signal Hsync is generated as the first logic voltage at a certain period. For example, the horizontal sync signal Hsync may be generated as the first logic voltage for about 750 ns after about three to seven horizontal periods elapse after a last data enable pulse of the first data enable signal DE1 falls. The first logic voltage may be a high voltage, and a second logic voltage may be a low voltage.

The first sync signal generator 212 generates the second vertical sync signal Vsync2 as the first logic voltage in a period in which the first vertical sync signal Vsync1 is generated as the first logic voltage and the horizontal sync signal Hsync is generated as the first logic voltage. Therefore, the second vertical sync signal Vsync2 is generated as the first logic voltage at a certain period.

The first sync signal generator 212 delays the first data enable signal DE1 by about three to seven horizontal periods to generate the second data enable signal DE2, for outputting the second data enable signal DE2 in a period in which the second vertical sync signal Vsync2 is generated as the second logic voltage.

Figure 6A:
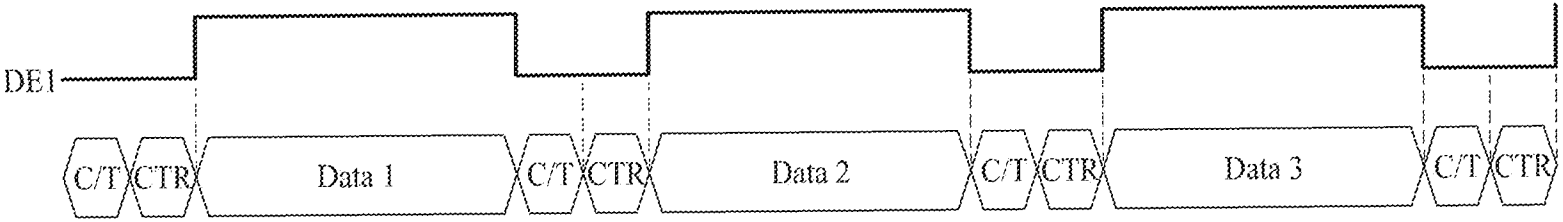
FIGS. 6A and 6B are waveform diagrams showing the first data enable signal and the second data enable signal, respectively, of FIG. 5.
Figure 6B:
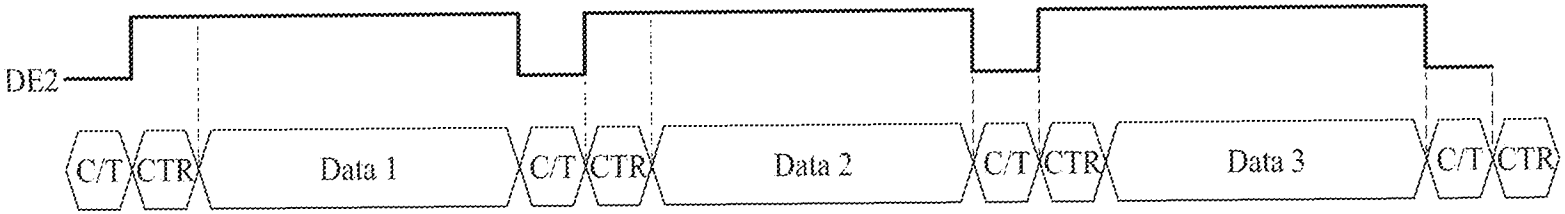

A data enable pulse of the first data enable signal DE1 may be synchronized with the digital video data DATA as in FIG. 6A, and in this case, may indicate a period in which the digital video data DATA is transmitted. Also, the data enable pulse of the second data enable signal DE2 may be synchronized with a control packet CTR and the digital video data DATA as in FIG. 6B, and in this case, may indicate transmission of the control packet CTR and the digital video data DATA. In FIGS. 6A and 6B, CT indicates clock training.

Moreover, the first sync signal generator 212 delays the control signals TTL1 from the timing controller 230 by about three to seven horizontal periods to output the delayed control signals TTL2.

Therefore, the V×1 transmitter 214 of the first transmission module 210 may transmit a transmission packet, obtained by converting compressed digital video data DATA, the control signals GCS and DCS, and the second timing signals TS2, to the first receiving module 170 in a period in which the second vertical sync signal Vsync2 is generated as the second logic voltage. Also, the second transmission module 180 may transmit the sensing data SD to the second receiving module 220 in a period in which the second vertical sync signal Vsync2 is generated as the second logic voltage.

Figure 7:
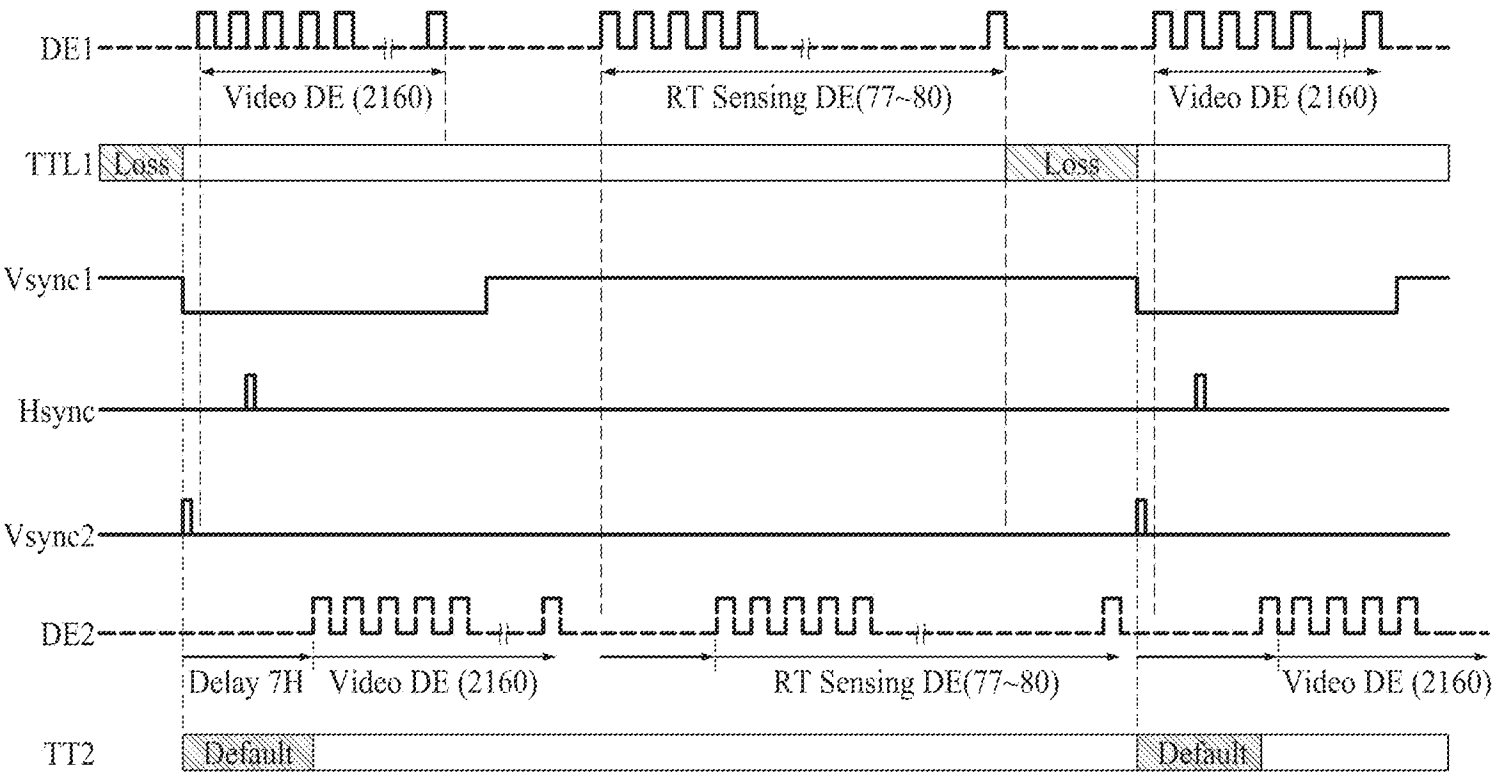
FIG. 7 is a waveform diagram showing a first data enable signal, a first vertical sync signal, and a horizontal sync signal output from a timing controller and a second data enable signal and a second vertical sync signal output from a first sync signal generator, in a second driving mode.

FIG. 7 is a waveform diagram showing a first data enable signal, a first vertical sync signal, and a horizontal sync signal output from a timing controller and a second data enable signal and a second vertical sync signal output from a first sync signal generator, in a second driving mode.

Hereinafter, a method of generating, by the first sync signal generator 212, the second vertical sync signal Vsync2 and the second data enable signal DE2 in the second driving mode will be described in detail with reference to FIG. 7.

Referring to FIG. 7, the second driving mode is an electron mobility compensation mode of sensing the source voltage of the driving transistor for compensating for the electron mobility of the driving transistor of each of the pixels during a period in which the display device is turned on to display an image. In the first driving mode, as soon as the display device is turned on, sensing is performed before displaying an image. On the other hand, in the second driving mode, an image is displayed in an active period, and sensing is performed in a vertical blank period. Such a difference is between the first driving mode and the second driving mode.

The timing controller 230 outputs the first vertical sync signal Vsync1, the horizontal sync signal Hsync, the first data enable signal DE1, and the control signals TTL1 in the second driving mode. Also, the timing controller 230 outputs the digital video data DATA including only first display video data and second sensing video data in the second driving mode. The first display video data denotes data which is to be supplied to each of the pixels for displaying an image. The second sensing video data denotes data which is to be supplied to each of the pixels so as to compensate for the electron mobility of the driving transistor.

In the second driving mode, the first vertical sync signal Vsync1 is generated as the first logic voltage at a certain period. A period in which the first vertical sync signal Vsync1 is generated as the first logic voltage corresponds to the vertical blank period, and a period in which the first vertical sync signal Vsync1 is generated as the second logic voltage corresponds to the active period.

In the second driving mode, the first data enable signal DE1 may include display data enable pulses generated in the active period and sensing data enable pulses generated in the vertical blank period. The number of the display data enable pulses may be larger than the number of the sensing data enable pulses. For example, the number of the display data enable pulses may be 2,160, and the number of the sensing data enable pulses may be 77 to 80.

In the second driving mode, the horizontal sync signal Hsync may be generated at a certain period, and for example, may be generated as the first logic voltage once at every active period.

The first sync signal generator 212 allows the second vertical sync signal Vsync2 to rise to the first logic voltage at a time when the first vertical sync signal Vsync1 falls to the second logic voltage. Also, the first sync signal generator 212 allows the second vertical sync signal Vsync2 to fall to the second logic voltage before a rising time of a first display data enable pulse of an active period of the first data enable signal DE1.

The first sync signal generator 212 delays the first data enable signal DE1 by about three to seven horizontal periods to generate the second data enable signal DE2, for outputting the second data enable signal DE2 in a period in which the second vertical sync signal Vsync2 is generated as the second logic voltage.

Therefore, the V×1 transmitter 214 of the first transmission module 210 may transmit a transmission packet, obtained by converting compressed digital video data DATA, the control signals GCS and DCS, and the second timing signals TS2, to the first receiving module 170 in a period in which the second vertical sync signal Vsync2 is generated as the second logic voltage. Also, the second transmission module 180 may transmit the sensing data SD to the second receiving module 220 in a period in which the second vertical sync signal Vsync2 is generated as the second logic voltage.

Figure 8:
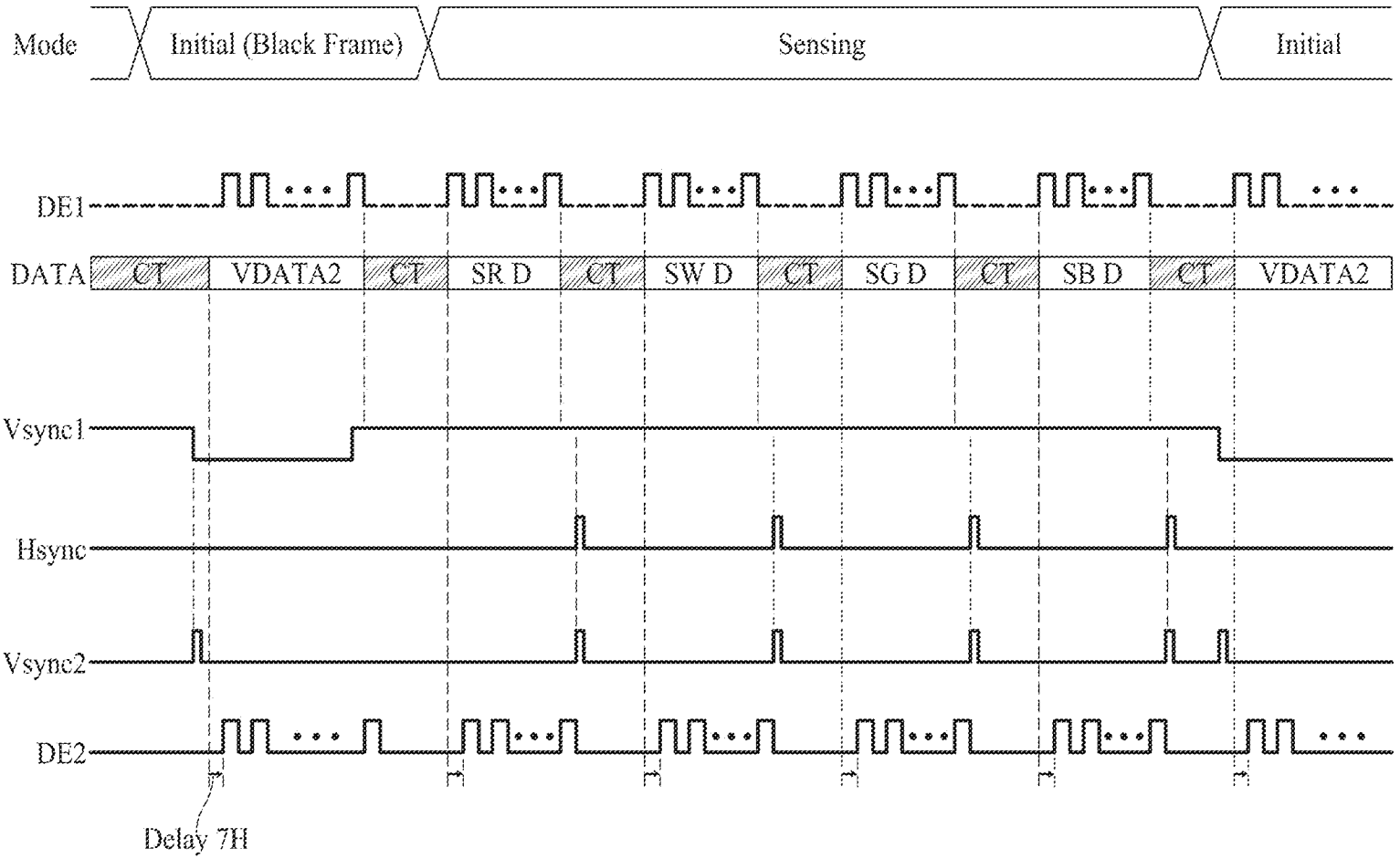
FIG. 8 is a waveform diagram showing a first data enable signal, a first vertical sync signal, and a horizontal sync signal output from a timing controller and a second data enable signal and a second vertical sync signal output from a first sync signal generator, in a third driving mode.

FIG. 8 is a waveform diagram showing a first data enable signal, a first vertical sync signal, and a horizontal sync signal output from a timing controller and a second data enable signal and a second vertical sync signal output from a first sync signal generator, in a third driving mode.

Referring to FIG. 8, the third driving mode is a threshold voltage compensation mode of sensing the source voltage of the driving transistor for compensating for the threshold voltage of the driving transistor of each of the pixels before the display device is turned off.

The timing controller 230 outputs the first vertical sync signal Vsync1, the horizontal sync signal Hsync, the first data enable signal DE1, and the digital video data DATA in the third driving mode. The digital video data DATA may include second display video data VDATA2 and third sensing video data. The third sensing video data may include red sensing data SRD, green sensing data SGD, blue sensing data SBD, and white sensing data SWD. The second display video data VDATA2 may be black data for initializing the gate electrode of the driving transistor before sensing the source voltage of the driving transistor. The third sensing video data denotes data which is to be supplied to each of the pixels so as to compensate for the threshold voltage of the driving transistor.

In the third driving mode, the first vertical sync signal Vsync1 is generated as the first logic voltage at a certain period. A period in which the first vertical sync signal Vsync1 is generated as the first logic voltage corresponds to the vertical blank period, and a period in which the first vertical sync signal Vsync1 is generated as the second logic voltage corresponds to the active period.

In the third driving mode, the first data enable signal DE1 may include display data enable pulses generated in the active period and sensing data enable pulses generated in the vertical blank period. The number of sensing data enable pulses of one group may be larger than the number of display data enable pulses of the one group. For example, the sensing data enable pulses of the one group may be generated for 30 ms to 200 ms. In a case where the sensing data enable pulses of the one group are generated for 30 ms, the one group may include about 8,500 data enable pulses.

In the third driving mode, the horizontal sync signal Hsync may be generated a plurality of times in a period in which the first vertical sync signal Vsync1 is generated as the first logic voltage.

The first sync signal generator 212 allows the second vertical sync signal Vsync2 to rise to the first logic voltage at a time when the first vertical sync signal Vsync1 falls to the second logic voltage. Also, the first sync signal generator 212 allows the second vertical sync signal Vsync2 to fall to the second logic voltage before a rising time of a first display data enable pulse of an active period of the first data enable signal DE1. Also, the first sync signal generator 212 may generate the second vertical sync signal Vsync2 as the first logic voltage in a period in which the first vertical sync signal Vsync1 is generated as the first logic voltage and the horizontal sync signal Hsync is generated as the first logic voltage.

A length (a second logic period length) of a period in which the second vertical sync signal Vsync2 is generated as the second logic voltage may have different values, based on a period in which the second display video data VDATA2 and the red sensing data SRD are transmitted and a period in which each of the green sensing data SGD, the blue sensing data SBD, and the white sensing data SWD is transmitted. That is, since the second display video data VDATA2 should be transmitted before the red sensing data SRD is transmitted, a second logic period length of the second vertical sync signal Vsync2 corresponding to a period in which the second display video data VDATA2 and the red sensing data SRD are transmitted may be longer than a second logic period length of the second vertical sync signal Vsync2 corresponding to a period in which each of the green sensing data SGD, the blue sensing data SBD, and the white sensing data SWD is transmitted.

The first sync signal generator 212 delays the first data enable signal DE1 by about three to seven horizontal periods to generate the second data enable signal DE2, for outputting the second data enable signal DE2 in a period in which the second vertical sync signal Vsync2 is generated as the second logic voltage.

Therefore, the V×1 transmitter 214 of the first transmission module 210 may transmit a transmission packet, obtained by converting compressed digital video data DATA, the control signals GCS and DCS, and the second timing signals TS2, to the first receiving module 170 in a period in which the second vertical sync signal Vsync2 is generated as the second logic voltage. Also, the second transmission module 180 may transmit the sensing data SD to the second receiving module 220 in a period in which the second vertical sync signal Vsync2 is generated as the second logic voltage.

As described above, frequencies of the second vertical sync signal Vsync2 respectively corresponding to the first to third driving modes differ. In the first and third driving modes, at least 8,500 data enable pulses are generated in a second logic voltage period of the second vertical sync signal Vsync2. On the other hand, in the second driving mode, 2,160 display data enable pulses and fewer sensing data enable pulses than the number of the display data enable pulses are generated in the second logic voltage period of the second vertical sync signal Vsync2, with respect to an UHD resolution. Therefore, a second logic period length of the second vertical sync signal Vsync2 corresponding to the first driving mode is longer than that of the second vertical sync signal Vsync2 corresponding to the second driving mode. Also, a second logic period length of the second vertical sync signal Vsync2 corresponding to the third driving mode is longer than that of the second vertical sync signal Vsync2 corresponding to the second driving mode.

Figure 9:
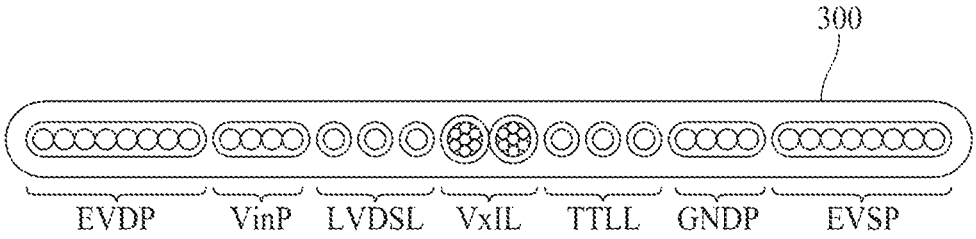
FIG. 9 is an exemplary diagram illustrating an example of a cable of FIG. 2.

FIG. 9 is an exemplary diagram illustrating an example of the cable of FIG. 2.

Referring to FIG. 9, the cable 300 may include a plurality of power pins, a plurality of V×1 transmission lanes V×1L, a plurality of TTL transmission lanes TTLL, and a plurality of LVDS transmission lanes LVDSL.

The plurality of power pins, as in FIG. 9, may include a high level voltage pin EVDP through which a high level voltage EVDD for driving the OLEDs of the pixels of the display panel 110 is supplied, a low level voltage pin EVSP through which a low level voltage EVSS is supplied, an input power pin VinP through which an input power Vin supplied to the source drive ICs of the display panel driver 120 is supplied, and a ground pin GNDP through which a ground voltage GND is supplied.

The V×1 transmission lanes V×1L may be lanes for transmitting a V×1 transmission packet transmitted from the V×1 transmitter 214 of the first transmission module 210. The number of the V×1 transmission lanes V×1L may be set based on the number of transmission bytes per lane and a resolution of the display module 100. This will be described below with reference to FIGS. 10A, 10B, 11A, and 11B.

The TTL transmission lanes TTLL may be lanes for transmitting signals between the first transmission module 210 and the first receiving module 170, for HDCP authentication.

The LVDS transmission lanes LVDSL may be lanes for transmitting a low voltage differential signal transmitted from the second transmission module 180.

FIGS. 10A and 10B are exemplary diagrams showing data transmitted by lanes of a cable in a case of transmitting digital video data through a V-by-one (V×1) interface in an FHD 4 byte mode and an FHD 5 byte mode.

Referring to FIGS. 10A and 10B, FHD denotes a 1920×1080 resolution, a 4 byte mode denotes a mode of transmitting red, green, blue, and white digital video data of 4 bytes per one lane, and a 5 byte mode denotes a mode of transmitting red, green, blue, and white digital video data of 5 bytes per one lane.

In FIGS. 10A and 10B, R1, W1, G1, and B1 denote pieces of digital video data which are to be supplied to 1st to 160th pixels supplied with data voltages through a first source drive IC of the display panel driver 120, and R2, W2, G2, and B2 denote pieces of digital video data which are to be supplied to 161st to 320th pixels supplied with data voltages through a second source drive IC of the display panel driver 120. Also, R3, W3, G3, and B3 denote pieces of digital video data which are to be supplied to 321st to 480th pixels supplied with data voltages through a third source drive IC of the display panel driver 120, and R4, W4, G4, and B4 denote pieces of digital video data which are to be supplied to 481st to 640th pixels supplied with data voltages through a fourth source drive IC of the display panel driver 120. Also, R12, W12, G12, and B12 denote pieces of digital video data which are to be supplied to 1761st to 1920th pixels supplied with data voltages through a twelfth source drive IC of the display panel driver 120. Also, in FIGS. 10A and 10B, R1[9:2] denotes R1 data of 2 to 9 bits.

In the 4 byte mode, data of 32 bits may be transmitted per one lane. In this case, data of RGBW 40 bits should be transmitted to one source drive IC, and if there are twelve source drive ICs, fifteen lanes (i.e., 40×12/32=15) are needed as in FIG. 10A.

In the 5 byte mode, data of 40 bits may be transmitted per one lane. In this case, data of RGBW 40 bits should be transmitted to one source drive IC, and if there are twelve source drive ICs, twelve lanes (i.e., 40×12/40=12) are needed as in FIG. 10B.

That is, the number of lanes necessary for transmission of digital video data in the 5 byte mode is smaller than the 4 byte mode. Accordingly, in an embodiment of the present disclosure, when bytes of digital video data capable of being transmitted to one lane increase, a size of a cable is reduced.

FIGS. 11A and 11B are exemplary diagrams showing data transmitted by lanes of a cable in a case of transmitting digital video data through a V×1 interface in a UHD 4 byte mode and a UHD 5 byte mode.

Referring to FIGS. 11A and 11B, UHD denotes a 3840×2160 resolution, a 4 byte mode denotes a mode of transmitting red, green, blue, and white digital video data of 4 bytes per one lane, and a 5 byte mode denotes a mode of transmitting red, green, blue, and white digital video data of 5 bytes per one lane.

In FIGS. 11A and 11B, R1, W1, G1, and B1 denote pieces of digital video data which are to be supplied to 1st to 192nd pixels, and R2, W2, G2, and B2 denote pieces of digital video data which are to be supplied to 193rd to 384th pixels. Also, R20, W20, G20, and B20 denote pieces of digital video data which are to be supplied to 3649th to 3840th pixels supplied with data voltages. Also, in FIGS. 11A and 11B, R1[9:2] denotes R1 data of 2 to 9 bits.

In the 4 byte mode, data of 32 bits may be transmitted per one lane. In this case, data of RGBW 40 bits should be transmitted to one source drive IC, and if there are twenty source drive ICs, twenty-five lanes (i.e., 40×20/32=25) are needed as in FIG. 11A.

In the 5 byte mode, data of 40 bits may be transmitted per one lane. In this case, data of RGBW 40 bits should be transmitted to one source drive IC, and if there are twenty source drive ICs, twenty lanes (i.e., 40×20/40=20) are needed as in FIG. 11B.

That is, the number of lanes necessary for transmission of digital video data in the 5 byte mode is smaller than the 4 byte mode. Accordingly, in an embodiment of the present disclosure, when bytes of digital video data capable of being transmitted to one lane increase, a size of a cable is reduced.

Figure 12:
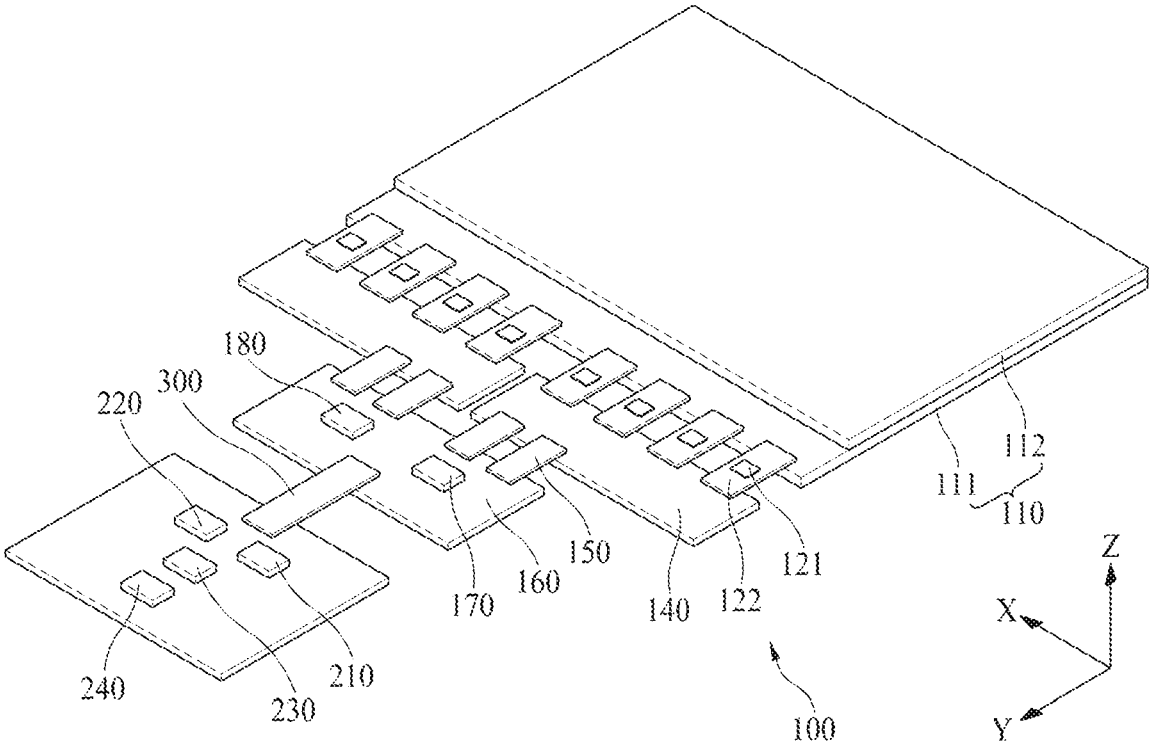
FIG. 12 is a perspective view illustrating a display device according to an embodiment of the present disclosure.

FIG. 12 is a perspective view illustrating a display device according to an embodiment of the present disclosure.

Referring to FIG. 12, the display device according to an embodiment of the present disclosure may include a display module 100, a system board 200, and a cable 300.

The display module 100, as in FIG. 12, may include a display panel 110, a plurality of source drive ICs 121, a plurality of flexible films 122, a source circuit board 140, a flexible cable 150, an interface board 160, a first receiving module 170, and a second transmission module 180. Here, the plurality of source drive ICs 121, the plurality of flexible films 122, the source circuit board 140, the flexible cable 150, and the interface board 160 may correspond to a display panel driver 120.

The display panel 110 may include a lower substrate 111 and an upper substrate 112. The lower substrate 111 may be formed of glass, plastic, and/or the like, and the upper substrate 112 may be formed of a plastic film, an encapsulation film, a barrier film, or the like.

The display panel driver 120 may include a scan driver and the plurality of source drive ICs 121 corresponding to a data driver. The source drive ICs 121 may be respectively attached on the flexible films 122. Each of the flexible films 122 may be attached on the lower substrate 111 of the display panel 110 and the source circuit board 140.

The source circuit board 140 may be provided in plurality, and the source circuit boards 140 may be connected to the interface board 160 through the flexible cable 150. A connector may be provided in each of the interface board 160 and the source circuit boards 140 so as to be connected to each other through the flexible cable 150.

The first receiving module 170 and the second transmission module 180 may each be implemented as an integrated circuit (IC). In this case, the second transmission module 180 may be referred to as a serdes transmission (serdes Tx) IC, and the first receiving module 170 may be referred to as a serdes receiving (serdes Rx) IC. A serdes (serializer/deserializer) denotes communication where parallel data is converted into serial data and the serial data is transmitted through a predetermined lane. In detail, conversion of parallel data into serial data may be referred to as a serializer, conversion of serial data into parallel data may be referred to as a deserializer, and the serdes may be the term which denotes the serializer and the deserializer. The first receiving module 170 and the second transmission module 180 may be mounted on the interface board 160.

The system board 200, as in FIG. 12, may include a first transmission module 210, a second receiving module 220, a timing controller 230, an SoC 240, and a power supply 250.

The first transmission module 210 and the second receiving module 220 may each be implemented as an IC. In this case, the first transmission module 210 may be referred to as a serdes transmission (serdes Tx) IC, and the second receiving module 220 may be referred to as a serdes receiving (serdes Rx) IC. The first transmission module 210 and the second receiving module 220 may be mounted on the system board 200.

The timing controller 230, the SoC 240, and the power supply 250 may each be implemented as an IC, and thus, may be mounted on the system board 200.

The cable 300 may connect the interface board 160 to the system board 200. A connector may be provided in each of the interface board 160 and the system board 200 so as to be connected to each other through the cable 300.

Figure 13:
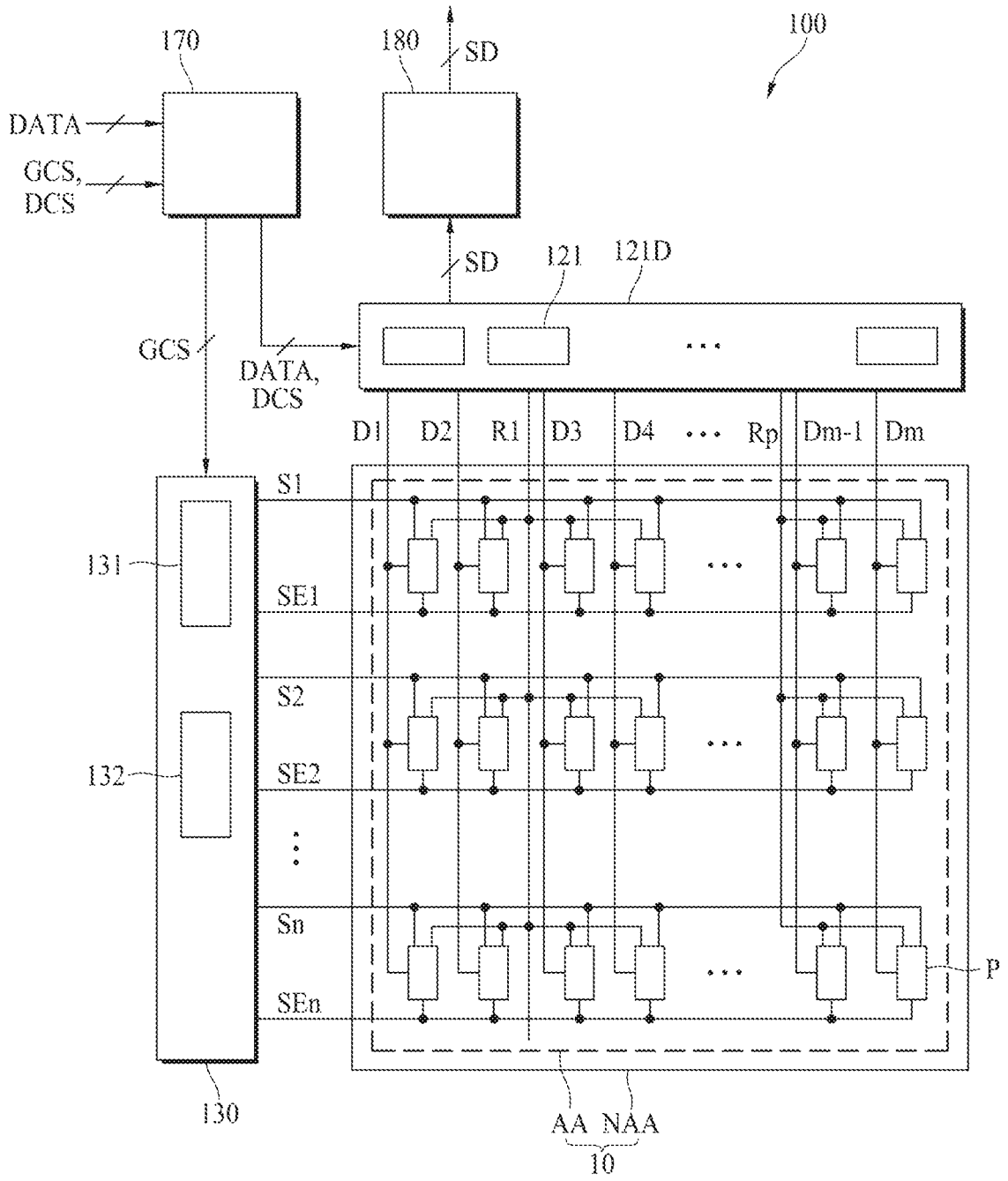
FIG. 13 is a block diagram schematically illustrating a display module of FIG. 12.

FIG. 13 is a block diagram schematically illustrating the display module of FIG. 12.

Hereinafter, elements of the display module will be described in detail with reference to FIG. 13. In an embodiment of the present disclosure, an example where the display module 100 is an organic light emitting display device will be described.

Referring to FIG. 13, the display panel 110 may include a display area (or an active area) AA and a non-display area (or an inactive area) NAA provided near the display area AA. The display area AA may be an area where a plurality of pixels P are provided to display an image. A plurality of data lines D1 to Dm (where m is a positive integer equal to or more than two), a plurality of reference voltage lines R1 to Rp (where p is a positive integer equal to or more than two), a plurality of scan lines S1 to Sn (where n is a positive integer equal to or more than two), and a plurality of sensing signal lines SE1 to SEn may be provided in the display panel 110. The data lines D1 to Dm and the reference voltage lines R1 to Rp may intersect the scan lines S1 to Sn and the sensing signal lines SE1 to SEn. The data lines D1 to Dm may be parallel with the reference voltage lines R1 to Rp. The scan lines S1 to Sn may be parallel with the sensing signal lines SE1 to SEn.

Each of the pixels P may be connected to one of the data lines D1 to Dm, one of the reference voltage lines R1 to Rp, one of the scan lines S1 to Sn, and one of the sensing signal lines SE1 to SEn. Each of the pixels P of the display panel 110, as in FIG. 14, may include an OLED and a plurality of transistors for supplying a current to the OLED. Each of the pixels P in the display area AA will be described below in detail with reference to FIG. 14.

The display panel driver 120, as in FIG. 13, may include a scan driver 130 and a data driver 121D.

Figure 14:
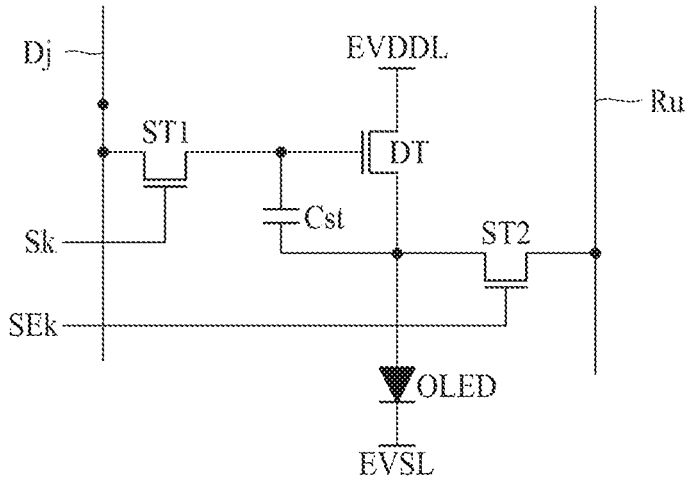
FIG. 14 is a circuit diagram of a pixel of FIG. 13.

The data driver 121D, as in FIG. 14, may include a plurality of source drive ICs 121. The source drive ICs 121 may each include a data voltage supply unit and a sensing unit.

The data voltage supply unit may be connected to the data lines to supply data voltages to the data lines. The data voltage supply unit may receive digital video data DATA and a data control signal DCS from the first receiving module 170. The data voltage supply unit may convert the digital video data DATA into the data voltages according to the data control signal DCS and may respectively supply the data voltages to the data lines.

The sensing unit may supply a reference voltage to the reference voltage lines R1 to Rp, sense source voltages of driving transistors of the pixels P through the reference voltage lines R1 to Rp, convert sensed voltages into digital sensing data, and output the digital sensing data to the second transmission module 180.

The scan driver 130 may include a scan signal output unit 131 and a sensing signal output unit 132.

The scan signal output unit 131 may supply scan signals to the scan lines S1 to Sn according to a scan control signal GCS input from the first receiving module 170. The sensing signal output unit 132 may supply sensing signals to the sensing signal lines SE1 to SEn according to the scan control signal GCS input from the first receiving module 170.

The scan signal output unit 131 and the sensing signal output unit 132 may each include a plurality of transistors and may be directly provided in the non-display area NAA of the display panel 110 in a gate driver in panel (GIP) type. Alternatively, each of the scan signal output unit 131 and the sensing signal output unit 132 may be configured as a driving chip type and may be mounted on a flexible film (not shown) connected to the display panel 110.

The first receiving module 170 may receive encrypted digital video data DATA, the scan control signal GCS, the data control signal DCS, and second timing signals TS2 from the first transmission module 210 of the system board 200 through a cable 300. The first receiving module 170 may decrypt the encrypted digital video data DATA and may transmit the decrypted digital video data DATA and the data control signal DCS to the data driver 121D. The first receiving module 170 may transmit the scan control signal GCS to the scan driver 130.

The second transmission module 180 may transmit the sensing data SD to the second receiving module 220 of the system board 200 through the cable 300.

FIG. 14 is a circuit diagram of the pixel of FIG. 13.

Referring to FIG. 14, the pixel P may include an organic light emitting diode OLED, a driving transistor DT, first and second switching transistors ST1 and ST2, and a storage capacitor Cst.

The organic light emitting diode OLED may emit light with a current supplied through the driving transistor DT. The organic light emitting diode OLED may include an anode electrode, a hole transporting layer, an organic light emitting layer, an electron transporting layer, and a cathode electrode. In the organic light emitting diode OLED, when a voltage is applied to the anode electrode and the cathode electrode, a hole and an electron may move to the organic light emitting layer through the hole transporting layer and the electron transporting layer and may be combined with each other to emit light. The anode electrode of the organic light emitting diode OLED may be connected to a source electrode of the driving transistor DT, and the cathode electrode may be connected to a second power line EVSL through which a second power lower than a first power is supplied.

The driving transistor DT may control a current flowing from a first power line EVDDL to the organic light emitting diode OLED, based on a voltage difference of a gate electrode and a source electrode thereof. The gate electrode of the driving transistor DT may be connected to a first electrode of the first switching transistor ST1, the source electrode may be connected to the anode electrode of the organic light emitting diode OLED, and a drain electrode may be connected to the first power line EVDDL.

The first switching transistor ST1 may be turned on by a kth scan signal of a kth scan line Sk and may connect a jth data line Dj to the gate electrode of the driving transistor DT. A gate electrode of the first switching transistor ST1 may be connected to the kth scan line Sk, the first electrode may be connected to the gate electrode of the driving transistor DT, and a second electrode may be connected to the jth data line Dj.

The second switching transistor ST2 may be turned on by a kth sensing signal of a kth sensing signal line SEk and may connect a uth reference voltage line Ru to the source electrode of the driving transistor DT. A gate electrode of the second switching transistor ST2 may be connected to the kth sensing signal line SEk, a first electrode may be connected to the uth reference voltage line Ru, and a second electrode may be connected to the source electrode of the driving transistor DT.

The first electrode of each of the first and second switching transistors ST1 and ST2 may be a source electrode, and the second electrode may be a drain electrode. However, the present embodiment is not limited thereto. In other embodiments, the first electrode of each of the first and second switching transistors ST1 and ST2 may be a drain electrode, and the second electrode may be a source electrode.

The storage capacitor Cst may be provided between the gate electrode and the source electrode of the driving transistor DT. The storage capacitor Cst may store a difference voltage between a gate voltage and a source voltage of the driving transistor DT.

The driving transistor DT and the first and second switching transistors ST1 and ST2 may each be configured as a thin film transistor. Also, an example where the driving transistor DT and the first and second switching transistors ST1 and ST2 are each configured as an N-type metal oxide semiconductor field effect transistor (MOSFET) has been described above with reference to FIG. 14, but the present embodiment is not limited thereto. In other embodiments, the driving transistor DT and the first and second switching transistors ST1 and ST2 may each be configured as a P-type MOSFET.

As described above, according to the embodiments of the present disclosure, the timing controller may be provided in the system board instead of the display module, and the transmission module and the receiving module may be provided in each of the display module and the system board. As a result, according to the embodiments of the present disclosure, bidirectional communication may be performed through a cable, and thus, in the organic light emitting display device using the external compensation method, although the timing controller is provided in the system board, the new interface for transmitting the digital video data of the timing controller of the system board to the display module and transmitting sensing data, sensed from the display panel, from the display module to the timing controller of the system board is provided.

Moreover, according to the embodiments of the present disclosure, the power supply as well as the timing controller may be provided in the system board instead of the display module, and a plurality of driving voltages may be supplied to the display module through a cable. As a result, according to the embodiments of the present disclosure, in addition to the power supply, the power plug for receiving power may be removed from the display device, thereby providing a slimmed display device.

It will be apparent to those skilled in the art that various modifications and variations can be made in the present disclosure without departing from the spirit or scope of the disclosures. Thus, it is intended that the present disclosure covers the modifications and variations of this disclosure provided they come within the scope of the appended claims and their equivalents.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A communication method, comprising:

receiving, by a timing controller of a system board, digital video data from a system on chip (SoC) having a scaler that converts input video data into the digital video data;

receiving, by a first transmission circuit of the system board, the digital video data and control signals from the timing controller of the system board;

converting, by the first transmission circuit of the system board, the digital video data and the control signals into a transmission packet;

transmitting the transmission packet from the first transmission circuit of the system board to a first receiving circuit of an interface board through a cable, the first transmission circuit electrically coupled between the timing controller and the first receiving circuit;

restoring the digital video data and the control signals from the transmission packet; and transmitting the restored digital video data and control signals from the first receiving circuit to a display panel driver that applies a plurality of driving signals to a display panel.

2. The communication method of claim 1, further comprising:

transmitting sensing data from the display panel driver to a second transmission circuit of the interface board;

converting the sensing data into a differential signal and transmitting the differential signal from the second transmission circuit of the interface board to a second receiving circuit of the system board through the cable; and transmitting the sensing data from the second receiving circuit to the timing controller of the system board.

3. The communication method of claim 2, wherein the transmitting the transmission packet through the cable is performed using a first high speed serial interface which does not include a clock.

4. The communication method of claim 3, wherein the transmitting the differential signal through the cable is performed using a second high speed serial interface including a clock.

5. The communication method of claim 4, wherein a speed of the first high speed serial interface is higher than a speed of the second high speed serial interface.

6. A communication method, comprising:

converting digital video data and control signals into a transmission packet;

transmitting the transmission packet from a first transmission circuit of a system board to a first receiving circuit of an interface board through a cable;

restoring the digital video data and the control signals from the transmission packet; and transmitting the restored digital video data and control signals from the first receiving circuit to a display panel driver that applies a plurality of driving signals to a display panel, wherein the converting of the digital video data and control signals includes:

generating a second data enable signal and a second vertical sync signal based on a first data enable signal, a first vertical sync signal, and a horizontal sync signal from a timing controller; and converting the digital video data, the second data enable signal, the second vertical sync signal, and the control signals into the transmission packet and transmitting the transmission packet from the first transmission circuit to the first receiving circuit through the cable.

7. The communication method of claim 6, wherein a frequency of the second vertical sync signal in a first driving mode in which the digital video data includes first sensing video data, differs from a frequency of the second vertical sync signal in a second driving mode in which the digital video data includes first display video data and second sensing video data.

8. The communication method of claim 7, wherein a frequency of the second vertical sync signal in a third driving mode in which the digital video data includes second display video data and third sensing video data, differs from the frequency of the second vertical sync signal in the second driving mode.

9. The communication method of claim 8, wherein a number of the second sensing video data during an active period is smaller than a number of the first sensing video data or a number of the third sensing video data during the active period.

10. The communication method of claim 6, wherein the generating of the second data enable signal and the second vertical sync signal includes generating the second vertical sync signal having a first logic voltage when the first vertical sync signal has the first logic voltage and the horizontal sync signal has the first logic voltage in a first driving mode.

11. The communication method of claim 10, wherein the generating of the second data enable signal and the second vertical sync signal includes:

in a second driving mode, allowing the second vertical sync signal to rise to a first logic voltage in synchronization with a time when the first vertical sync signal falls to a second logic voltage; and allowing the second vertical sync signal to fall to the second logic voltage before the first data enable signal rises to the first logic voltage.

12. The communication method of claim 11, wherein the generating of the second data enable signal and the second vertical sync signal includes:

in a third driving mode, allowing the second vertical sync signal to rise to a first logic voltage in synchronization with a time when the first vertical sync signal falls to a second logic voltage;

allowing the second vertical sync signal to fall to the second logic voltage before the first data enable signal rises to the first logic voltage; and generating the second vertical sync signal having the first logic voltage when the first vertical sync signal has the first logic voltage and the horizontal sync signal has the first logic voltage.

13. The communication method of claim 1, further comprising supplying a plurality of driving voltages from the first transmission circuit to the first receiving circuit through the cable.

14. The communication method of claim 1, wherein the converting of the digital video data and control signals includes:

in a p (where p is a positive integer equal to or more than two) byte mode, transmitting the digital video data using r (where r is a positive integer) number of channels of the cable; and in a q (where q is a positive integer more than p) byte mode, transmitting the digital video data using s (where s is a positive integer less than r) number of channels of the cable.

15. The communication method of claim 1, further comprising:

encrypting the digital video data before converting the digital video data and the control signals into the transmission packet; and decrypting the encrypted digital video data after restoring the digital video data and the control signals from the transmission packet.

16. A display device, comprising:

a display panel, a display panel driver that applies a plurality of driving signals to the display panel, and an interface board including a first receiving circuit;

a system board including:

a system on chip (SoC) having a scaler that converts input video data into digital video data having a resolution suitable for display by the display panel;

a timing controller that receives the digital video data from the SoC, and outputs the digital video data and control signals for controlling an operation timing of the display panel driver, and a first transmission circuit that receives the digital video data and control signals from the timing controller, and communicates with the first receiving circuit, the first transmission circuit electrically coupled between the timing controller and the first receiving circuit; and a cable that connects the interface board to the system board, wherein the first transmission circuit converts the digital video data and the control signals from the timing controller into a transmission packet, and transmits the transmission packet to the first receiving circuit through the cable.

17. The display device of claim 16, wherein the first receiving circuit restores the digital video data and the control signals from the transmission packet, and transmits the restored digital video data and control signals to the display panel driver.

18. The display device of claim 17, wherein:

the interface board further includes a second transmission circuit that receives sensing data from the display panel driver and transmits the sensing data to the system board through the cable; and the system board further includes a second receiving circuit that transmits the sensing data, received from the second transmission circuit, to the timing controller.

19. The display device of claim 18, wherein the first transmission circuit and the first receiving circuit communicate with each other using a first high speed serial interface which does not include a clock.

20. The display device of claim 19, wherein the second transmission circuit and the second receiving circuit communicate with each other using a second high speed serial interface including a clock.

21. The display device of claim 20, wherein a speed of the first high speed serial interface is higher than a speed of the second high speed serial interface.

22. The display device of claim 16, wherein the first transmission circuit generates a second data enable signal and a second vertical sync signal based on a first data enable signal, a first vertical sync signal, and a horizontal sync signal from the timing controller, converts the digital video data, the second data enable signal, the second vertical sync signal, and the control signals into the transmission packet, and transmits the transmission packet to the first receiving circuit through the cable.

23. The display device of claim 22, wherein a frequency of the second vertical sync signal in a first driving mode in which the digital video data includes first sensing video data, differs from a frequency of the second vertical sync signal in a second driving mode in which the digital video data includes first display video data and second sensing video data.

24. The display device of claim 23, wherein the frequency of the second vertical sync signal in the second driving mode differs from a frequency of the second vertical sync signal in a third driving mode in which the digital video data includes second display video data and third sensing video data or includes only the third sensing video data.

25. The display device of claim 24, wherein a number of the second sensing video data during an active period is smaller than a number of the first sensing video data or a number of the third sensing video data during the active period.

26. The display device of claim 22, wherein in a first driving mode, when the first vertical sync signal has a first logic voltage and the horizontal sync signal has the first logic voltage, the first transmission circuit generates the second vertical sync signal having the first logic voltage.

27. The display device of claim 26, wherein in a second driving mode, the first transmission circuit allows the second vertical sync signal to rise to a first logic voltage in synchronization with a time when the first vertical sync signal falls to a second logic voltage, and allows the second vertical sync signal to fall to the second logic voltage before the first data enable signal rises to the first logic voltage.

28. The display device of claim 27, wherein in a third driving mode, the first transmission circuit allows the second vertical sync signal to rise to a first logic voltage in synchronization with a time when the first vertical sync signal falls to a second logic voltage, allows the second vertical sync signal to fall to the second logic voltage before the first data enable signal rises to the first logic voltage, and generates the second vertical sync signal having the first logic voltage when the first vertical sync signal has the first logic voltage and the horizontal sync signal has the first logic voltage.

29. The display device of claim 18, wherein:

the system board further comprises a voltage supply unit that generates and outputs a plurality of driving voltages; and the plurality of driving voltages are supplied from the first transmission circuit to the first receiving circuit through the cable.

30. The display device of claim 17, wherein:

in a p (where p is a positive integer equal to or more than two) byte mode, the digital video data is transmitted using r (where r is a positive integer) number of channels of the cable; and in a q (where q is a positive integer more than p) byte mode, the digital video data is transmitted using s (where s is a positive integer less than r) number of channels of the cable.

31. The display device of claim 29, wherein the cable includes a plurality of power pins for supplying the plurality of driving voltages, a plurality of first transmission lanes for transmitting the transmission packet from the first transmission circuit to the first receiving circuit, and a plurality of second transmission lanes for transmitting a differential signal of the sensing data from the second transmission circuit to the second receiving circuit.

32. The display device of claim 17, wherein the first transmission circuit encrypts the digital video data before converting the digital video data and the control signals into the transmission packet, and the first receiving circuit decrypts the encrypted digital video data after restoring the digital video data and the control signals from the transmission packet.

* * * * *